US005391243A

United States Patent [19]

Goto et al.

[11] Patent Number: 5,391,243

[45] Date of Patent: Feb. 21, 1995

[54] METHOD FOR PRODUCING WIRE FOR ELECTRIC RAILWAYS

[75] Inventors: Motoo Goto; Shizuo Kawakita, both of Ohte; Yoshiharu Mae, Ohmiya; Takuro Iwamura; Yutaka Koshiba, both of Ohte; Kenji Yajima, Ohmiya; Syunji Ishibashi, Ohte; Hiroki Nagasawa, Kokubunji; Atsushi Sugahara, Kokubunji; Sumihisa Aoki, Kokubunji; Haruhiko Asao, Ohte, all of Japan

[73] Assignees: Mitsubishi Materials Corporation; Railway Technical Research Institute, both of Tokyo, Japan

[21] Appl. No.: 145,474

[22] Filed: Oct. 28, 1993

Related U.S. Application Data

[62] Division of Ser. No. 55,205, Apr. 30, 1993.

[30] Foreign Application Priority Data

May 8, 1992 [JP] Japan ..... 4-143201
Nov. 17, 1992 [JP] Japan ..... 4-331024

[51] Int. Cl.[6] ..... C22F 1/08

[52] U.S. Cl. ..... 148/554; 148/682; 148/685

[58] Field of Search ..... 148/554, 680, 681, 682, 148/683, 685, 686

[56] References Cited

U.S. PATENT DOCUMENTS

| | | | |
|---|---|---|---|
| 3,143,442 | 8/1964 | Watts | 148/686 |
| 3,717,511 | 2/1973 | Wallbaum et al. | 148/680 |
| 4,451,430 | 5/1984 | Matidori et al. | 420/492 |
| 4,749,548 | 6/1988 | Akutsu et al. | 420/495 |
| 4,755,235 | 7/1988 | Matidori et al. | 148/411 |

FOREIGN PATENT DOCUMENTS

| | | | |
|---|---|---|---|
| 0023362 | 2/1981 | European Pat. Off. . | |
| 1578403 | 7/1969 | France . | |
| 55-134161 | 10/1980 | Japan | 148/685 |
| 59-193233 | 11/1984 | Japan . | |
| 60-194030 | 10/1985 | Japan . | |
| 60-53739 | 11/1985 | Japan . | |
| 63-3936 | 1/1988 | Japan . | |
| 63-125631 | 5/1988 | Japan . | |
| 63-149344 | 6/1988 | Japan . | |
| 63-303020 | 12/1988 | Japan . | |
| 64-62428 | 3/1989 | Japan . | |
| 2-170932 | 7/1990 | Japan . | |
| 3-56632 | 3/1991 | Japan . | |
| 3-56633 | 3/1991 | Japan . | |

OTHER PUBLICATIONS

Taubenblat, P. W., et al., "A New Copper Alloy with High Strength and Conductivity", *Metals Engineering Quaterly*, Nov. 1972, pp. 41–44.

Patent Abstracts of Japan, vol. 15, No. 206 (C-835) May 27, 1991 & JP-A-03 056 632 (Furukawa).

Patent Abstracts of Japan, vol. 15, No. 206 (C-835) May 27, 1991 & JP-A-03 056 633 (Furukawa).

*Primary Examiner*—George Wyszomierski

*Attorney, Agent, or Firm*—Frishauf, Holtz, Goodman & Woodward

[57] ABSTRACT

A wire for electric railways comprises a copper alloy which consists essentially, by weight percent, of 0.1 to 1.0% Cr, 0.01 to 0.3% Zr, and 10 ppm or less O, and if required, further contains at least one element selected from the group consisting of 0.01 to 0.1% Si and 0.001 to 0.05% Mg, with the balance being Cu and inevitable impurities. The wire is manufactured by hot working a copper alloy billet having the above composition, immediately quenching the hot worked billet to prepare an element wire, cold working the element wire at least once, and subjecting the cold worked element wire to aging treatment.

74 Claims, 1 Drawing Sheet

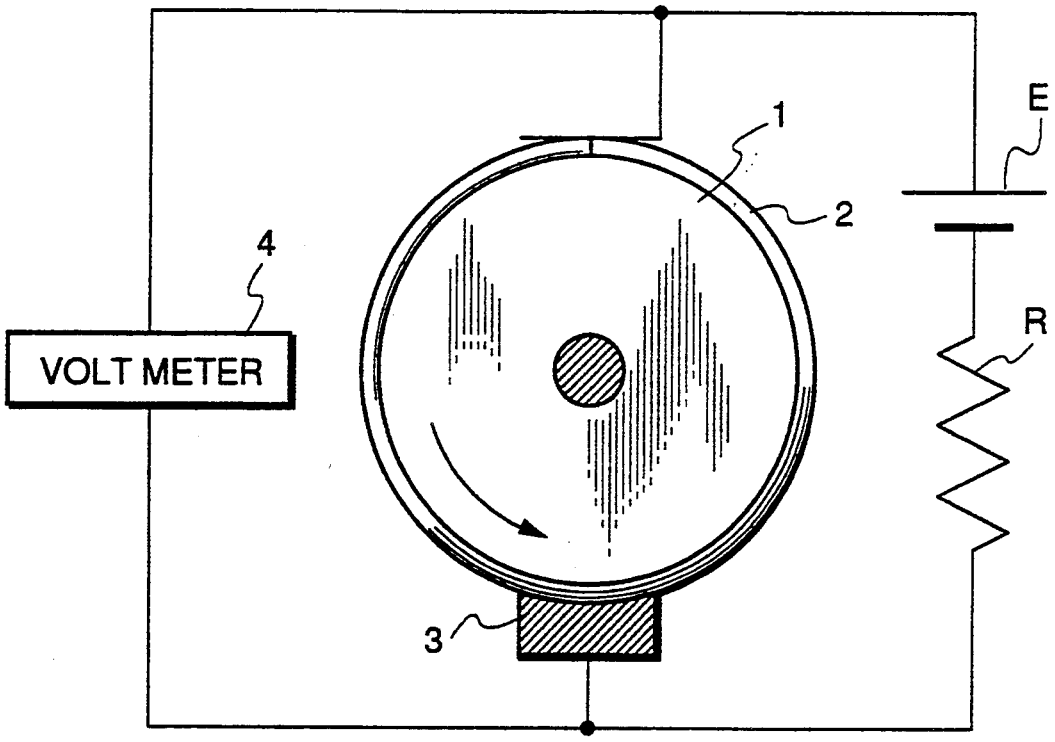
1
2
E
4
VOLT METER
R
3

METHOD FOR PRODUCING WIRE FOR ELECTRIC RAILWAYS

This is a division of application Ser. No. 08/055,205, filed Apr. 30, 1993.

BACKGROUND OF THE INVENTION

1. Field of the Invention

This invention relates to a wire for use as overhead lines in electric railways, and a method of producing the same.

2. Prior Art

It is known that overhead lines for electric railways include in general contact wires for supplying electric power to electric rolling stocks, messenger wires for supplementing power to the electric rolling stocks and for supporting the contact wires in air, and auxiliary messenger wires for supporting the messenger wires.

These wires have conventionally been formed of pure copper or copper alloys containing 0.3 percent by weight Sn.

As is seen in super-express railways such as the Shinkansen, higher speed performance is increasingly required of electric rolling stocks manufactured in recent years, and an increase in wire tension is required of the wires. Accordingly, wires having higher tension are demanded.

To meet such demand, recently, copper alloy wires containing Cr and Zr and having a fundamental composition of the precipitation hardening type have been proposed for use as a wire having high tension. For example, in Japanese Provisional Patent Publications (Kokai) Nos. 3-56632 and 3-56633, there have been proposed wires each formed of a copper alloy having a chemical composition containing, by weight percent (hereinafter referred to "%"), 0.001 to 0.35% Zr, and 0.01 to 1.2% Cr, and if required, further containing 1.5% or less at least one element selected from the group consisting of 0.3% or less Mg, 1.5% or less Zn, 0.2% or less Ag, 0.5% or less Cd, and the balance of Cu and inevitable impurities including Sn, Si, P, Fe, Ni, Pb, As, Sb, Bi and Si whose contents are limited as follows: Sn: 100 ppm or less; Si: 50 ppm or less; P: 50 ppm or less; Fe: 100 ppm or less; Ni: 100 ppm or less; Pb: 20 ppm or less; As: 20 ppm or less; Sb: 20 ppm or less; Bi: 20 ppm or less; and Si: 10 ppm or less.

These wires formed of the copper alloys containing Cr and Zr are manufactured in the following manner: First, a copper alloy ingot having a predetermined composition is prepared, and the prepared alloy ingot is hot rolled or hot extruded at a temperature of 700° to 850° C. to produce a roughly rolled coil of pure copper or a copper alloy having a large diameter and a short length, followed by solution treatment thereof. Thereafter, cold drawing and aging treatment are repeated, to thereby effect wire drawing to a predetermined size. Thus, the wires are manufactured (see Japanese Patent Publications (Kokoku) Nos. 60-53739, 63-3936, etc.)

In recent years, however, it is not unusual for newly manufactured electric rolling stocks to have a speed as high as 350 kph or more. Accordingly, in order to ensure stable sliding contact of a pantograph of an electric rolling stock with a contact wire, it is required that the wire tension of the contact wire and the messenger wire be made larger than conventional wires and the wires of contact line (formed of a contact wire, a messenger wire, and an auxiliary messenger wire) be made lighter in view of the wave propagation velocity. However, none of the above-mentioned known wires are fully satisfactory in tensile strength, and therefore., wires more excellent in mechanical strength have been desired.

More specifically, in conventional wires of contact line which were previously formed of a copper contact wire and a messenger wire of a hard copper strand, a steel-cored copper contact wire having the same cross sectional area as the conventional copper contact wire has been used in place of the copper contact wire in recent years. As a result, the power-feeding capacity of the contact wire has decreased, whereby the messenger wire is required to share an increased rate of feeding of electric power (by about 60% or larger) than before to compensate for the decreased power-feeding capacity of the contact wire. Further, in these years, the power consumption per electric rolling stock has increased in electric railways, and the number of electric rolling stocks has also been increased.

On the other hand, since electric rolling stocks run faster, it is required that the whole wires of contact line be made lighter in weight in order that electric rolling stocks can stably collect power, in view of the wave propagation velocity. Messenger wires have thus been rendered smaller in diameter, e.g. a messenger wire formed of 7 fine wires each having a diameter of 4.3 mm has been replaced by one formed of 7 fine wires each having a diameter of 3.7 mm. Accordingly, since a larger amount of current than before flows through the messenger wire, the amount of heat generation thereof has become larger. To cope with the above problems, materials for messenger wires are demanded, which are excellent in tensile strength as well as a thermal creep resistance up to 200° C. or 300° C.

Messenger wires are maintained taut by their own tension obtained by weights having a weight of about 1000 kg and vertically hung at both ends of the wire. However, as electric rolling stocks pass, a repeated bending stress is applied to the ends of the wire. If the stress applied to the ends occurs tens of thousands of times, rupture would occur at the ends of the wire. Therefore, ends of messenger wires are required to be excellent in 90 degree repeated bending properties.

Further, a wire which is poor in pressure weldability suffers from rupture at a pressure welded portion thereof or in the vicinity thereof. Furthermore, if the tensile strength at the pressure welded portion is low, the wire is sometimes cut at the pressure welded portion, which can cause an accident.

SUMMARY OF THE INVENTION

It is therefore an object of the invention to provide a wire for use in electric railways, which is formed of a copper alloy excellent in pressure weldability, and is much superior to conventional wires in resistance to wear in sliding contact with a wire while collecting current (hereinafter referred to as "current-collecting sliding wear resistance") as well as in tensile strength.

It is another object of the invention to provide a method of manufacturing a wire for an electric railway, which is capable of manufacturing the wire on a mass production basis at a low cost.

To attain the first-mentioned object, the present invention provides a wire for an electric railway, comprising a copper alloy consisting essentially, by weight percent, of 0.1 to 1.0% Cr, 0.01 to 0.3% Zr, 10 ppm or less O, and the balance of Cu and inevitable impurities.

The copper alloy may further contain 0.01 to 0.1% Si, or 0.01 to 0.1% Si and 0.001 to 0.05% Mg, if required.

To attain the second-mentioned object, the present invention provides a method of producing a wire for an electric railway from a copper alloy billet having the above-mentioned composition.

A first method of the invention comprises the steps of:

(a) hot working the copper alloy billet at a temperature of 860° to 1000° C. and at a draft of 90% or more;

(b) then immediately quenching the resulting alloy billet to prepare an element wire;

(c) cold working the prepared element wire at least once; and (d) subjecting the cold worked element wire to aging treatment.

A second method of the invention comprises the steps of:

(a) hot working the copper alloy billet at a temperature of 860° to 1000° C. and at a draft of 90% or more;

(b) then immediately quenching the resulting alloy billet to prepare an element wire; and (c) subjecting the prepared element wire to repeated cold working and aging treatment at least twice.

A third method of the invention comprises the steps of:

(a) hot working the copper alloy billet at a temperature of 860° to 1000° C. and at a draft of 90% or more;

(b) then allowing the resulting alloy billet to cool in air;

(c) subjecting the cooled alloy billet to solution treatment including heating the cooled alloy billet to a temperature of 860° to 1000° C. and then quenching the same, thereby obtaining an element wire;

(d) cold working the obtained element wire at least once; and (e) subjecting the cold worked element wire to aging treatment.

A fourth method of the invention comprises the steps of:

(a) hot working the copper alloy billet at a temperature of 860° to 1000° C. and at a draft of 90% or more;

(b) then allowing the resulting alloy billet to cool in air;

(c) subjecting the cooled alloy billet to solution treatment including heating the cooled alloy billet to a temperature of 860° to 1000° C. and then quenching the same, thereby obtaining an element wire;

(d) subjecting the obtained element wire to repeated cold working and aging treatment at least twice.

Preferably, the hot working is hot rolling.

Also preferably, the cold working comprises at least one operation of cold drawing at a surface area reduction ratio of 40% or more per one operation of cold drawing.

Further preferably, the aging treatment is carried out at a temperature of 350° to 600° C. for 0.1 to 6 hours.

Still further preferably, the aging treatment comprises at least two operations of aging treatment, the last one operation thereof being carried out a temperature lower than a temperature at which at least one preceding operation is carried out.

Advantageously, the copper alloy billet may be prepared by a method comprising the steps of:

(a) melting copper while blowing a reducing gas into the copper in a melt state;

(b) temporarily adding copper oxide to the resulting molten copper during execution of the step (a) to prepare a molten copper having an oxygen content of 10 ppm or less;

(c) adding alloy elements to the molten copper in predetermined amounts; and (d) casting the molten copper containing the alloy elements in a metal mold.

The above and other objects, features and advantages of the invention will be more apparent from the ensuring detailed description.

BRIEF DESCRIPTION OF THE DRAWING

The single FIGURE is a schematic view showing a device for measuring current-collecting sliding wear resistance properties of wires.

DETAILED DESCRIPTION

Under the aforementioned circumstances, the present inventors have made studies in order to obtain a wire for electric railways, which is excellent in pressure welding strength, current-collecting sliding wear resistance, high-temperature creep properties, and other mechanical strength such as tension of the wires, and as a result, have reached the following finding:

If in a wire for electric railways, which comprises a copper alloy containing 0.1 to 1.0% Cr, and 0.01 to 0.3% Zr, and if required, further containing at least one element selected from the group consisting of 0.01 to 0.1% Si, and 0.001 to 0.05% Mg, with the balance being Cu and inevitable impurities, the oxygen content is reduced to 10 ppm or less, the current-collecting sliding wear resistance as well as the tensile strength of the wire are increased, and further, pressure weldability thereof is also improved.

The present invention is based upon the above finding.

Therefore, the wire for electric railways according to the invention comprises a copper alloy consisting essentially of 0.1 to 1.0% Cr, 0.01 to 0.3 Zr, and 10 ppm or less O, and if required, further containing at least one element of 0.01 to 0.1% Si and 0.001 to 0.05% Mg, and the balance of Cu and inevitable impurities.

To manufacture the wire for electric railways according to the invention, first a billet of copper containing oxygen in a very small amount is prepared, followed by rolling the thus prepared billet into element wires. Generally, it is technically possible to prepare billets containing oxygen in an amount of 10 ppm or less in small quantities by the use of a vacuum melting furnace on a laboratory basis. However, it is difficult to manufacture the above billets by the vacuum melting furnace on a mass production basis, resulting in high costs. According to the invention, this problem has been solved by manufacturing a copper alloy billet to be formed into wires in the following manner: A reducing gas is blown through a graphite nozzle into a molten copper obtained by melting ordinary oxygen-free copper. During blowing of the reducing gas, copper oxide is temporarily added thereto, followed by further blowing the reducing gas, thereby preparing a molten copper containing oxygen in such a very small amount of 10 ppm or less. Then, Cr, and further Zr, Si and Mg are added in respective predetermined amounts to the molten copper containing oxygen in such a very small amount. The resulting molten alloy is cast into a cylindrical or a prismatic billet. The above-mentioned method of adding copper oxide to molten copper during blowing of a reducing gas into the molten copper to thereby reduce the oxygen content to 10 ppm or less has not yet been known and is advantageously capable of producing in large quantities molten copper containing oxygen in a very small amount.

The billet thus produced is subjected to hot working by heating preferably under a reducing atmosphere at a temperature of 860° to 1000° C. and at a draft of 90% or more per one time of hot working, to thereby produce an element wire. Before the thus produced element wire is cooled to 860° C. or below, the element wire is water cooled or quenched by gas. Alternatively, the element wire is allowed to cool in air after being subjected to the hot working, followed by solution treatment including again heating at 860° to 1000° C. for 0.1 to 6 hours and then quenching. Further, after repeated cold working, aging treatment is performed, or alternatively cold working and aging treatment are alternately repeated, thereby manufacturing a wire having a predetermined cross sectional area.

The draft employed in the above-mentioned cold working is preferably 40% or more at one time, and more preferably, the draft in the last cold working is 70% or more. The temperature of the aging treatment is preferably in the range of 350° to 600° C. In the repeated cold working and aging treatment which are each carried out at least twice, it is more preferable that the temperature of the last aging treatment be lower than the temperature of the preceding aging treatment(s).

Therefore, a first method of producing a wire for an electric railway according to the invention comprises the steps of: (a) hot working a copper alloy billet consisting essentially of 0.1 to 1.0% Cr, 0.01 to 0.3% Zr and 10 ppm or less oxygen, and if required, further containing at least one element selected from the group consisting of 0.01 to 0.1% Si, 0.001 to 0.05% Mg, and the balance of Cu and inevitable impurities, the copper alloy billet being prepared by the above described manner, at a temperature of 860° to 1000° C. and at a draft of 90% or more; (b) then immediately quenching the element wire; (c) cold working the prepared element wire at least once; and (d) subjecting the cold worked element wire to aging treatment.

A second method of producing a wire for an electric railway according to the invention comprises the steps of: (a) hot working the copper alloy billet having the above-mentioned composition and manufactured in the above described manner, at a temperature of 860° to 1000° C. and at a draft of 90% or more into an element wire; (b) then immediately quenching element wire; and (c) subjecting the prepared element wire to repeated cold working and aging treatment at least twice.

A third method of producing a wire for an electric railway according to the invention comprises the steps of: (a) hot working the copper alloy billet having the above-mentioned composition and manufactured in the above described manner, at a temperature of 860° to 1000° C. and at a draft of 90% or more into an element wire; (b) then allowing the element wire to cool in air; (c) subjecting the cooled element wire to solution treatment including heating the cooled element wire to a temperature of 860° to 1000° C. and then quenching, thereby obtaining an element wire; (d) cold working the obtained element wire at least once; and (e) then subjecting the cold worked element wire to aging treatment.

A fourth method of producing a wire for an electric railway according to the invention comprises the steps of: (a) hot working the copper alloy billet having the above-mentioned composition and manufactured in the above described manner at a temperature of 860° to 1000° C. and at a draft of 90% or more; into an element wire (b) then allowing the element wire to cool in air; (c) subjecting the cooled element wire to solution treatment including heating the cooled element wire to a temperature of 860° to 1000° C. and then quenching the element wire; and (d) subjecting the obtained element wire to repeated cold working and aging treatment at least twice.

Among the four methods of the present invention, wires can be produced at the lowest cost by the first method.

Wires can be produced at the second lowest cost by the second method. Further, according to this method, the electric conductivity of the wires can be slightly greater (by 2 to 3% IACS) than that of the wires obtained by the first method.

Wires can be produced at the third lowest cost by the third method. Further, according to this method, the tensile strength of the wires can be slightly greater (by 2 to 4 kg/mm$^2$) than those of the wires obtained by the first and second methods, while maintaining the same electric conductivity of the wires obtained by the second method.

The fourth method costs the maximum to produce the wires. However, wires obtained by this method have the best properties. Specifically, the tensile strength of the wires is 2 to 3 kg/mm$^2$ greater than that of the wires by the third method, and the electric conductivity thereof is greater than any of those obtained by the other three methods.

The contents of the components of the copper alloy forming the wire for an electric railway according to the invention have been limited as previously stated for the following reasons:

(a) Cr and Zr:

Both of Cr and Zr are present in the Cu basis in the form of particles dispersed therein, and act to improve the wear resistance and the heat resisting strength. However, when the Cr content exceeds 1.0%, or the Zr content exceeds 0.3%, the dispersed particles become coarser to thereby decrease the strength at a pressure welded portion of the finished wire formed from the alloy. As a result, the arcing rate unfavorably increases, thereby degrading the current-collecting sliding wear resistance. On the other hand, when the Cr content is below 0.1%, or the Zr content is below 0.01%, the above action cannot be performed to a desired extent. Therefore, the contents of Cr and Zr are limited within the ranges of 0.1 to 1.0% and 0.01 to 0.3%, respectively. Preferably, the Cr content should be 0.15 to 0.50%, and the Zr content 0.05 to 0.25%, respectively.

(b) Si:

Si acts to improve the tensile strength and the pressure welding strength, and further to increase the sliding wear resistance. However, when the Si content is below 0.01%, the above action cannot be performed to a desired extent. On the other hand, when the Si content exceeds 0.1% the electric conductivity decreases. Therefore, the Si content is limited within the range of 0.01 to 0.1%. Preferably, the Si content should be 0.01 to 0.05%.

(c) Mg:

Mg, like Si, acts to improve the sliding wear resistance. However, when the Mg content is below 0.001%, the above action cannot be performed to a desired extent, whereas when the Mg content exceeds 0.05%, it will result in degraded conformability between the wire and a current-collecting plate. Therefore, the Mg content is limited within the range of 0.001 to 0.05%. Preferably, the Mg content should be 0.005 to 0.03%.

(d) Oxygen:

If oxygen is present in an amount of more than 10 ppm, it reacts with Cr, Zr, Si and Mg to form crystals mainly formed of oxides thereof, the size of which is likely to become 2 μm or larger. When crystals having a size of 2 μm or larger are present in the wire basis, the strength at a pressured welded joint or in the vicinity thereof decreases, causing an increased arcing rate, which can cause heavy damage to the wire. Therefore, the oxygen content is limited to 10 ppm or below. Preferably, the oxygen content should be 1 to 7 ppm.

An example of the invention will now be explained hereinbelow.

EXAMPLE

As a starting material, an electrolytic copper containing oxygen in an amount of 20 ppm was charged into a graphite crucible and then melted under an atmosphere of Ar gas. When the temperature of the resulting molten copper became 1200° C., CO gas was continuously blown into the crucible at a flow rate of about 10 liter/-min through a graphite nozzle for 10 minutes. Then, 1000 g $Cu_2O$ powder was instantaneously blown through the graphite nozzle, followed by further blowing the CO gas for 10 minutes, thereby preparing a molten copper containing $O_2$ in an amount as small as 10 ppm or less. Added to the thus prepared molten copper were Cr, and further Zr, Si and Mg while stirring the molten copper, to obtain a molten copper alloy. Then, the thus obtained molten copper alloy was cast into a metallic die, to prepare billet specimens (A) to (K) according to the present invention and comparative billet specimens (a) to (g) each having a size of 250 mm in diameter and 3 m in length and having compositions shown in Tables 1 and 2. The comparative billet specimens (a), (b), (f) and (g) which contain $O_2$ in an amount exceeding 10 ppm, and a conventional billet specimen were prepared by the conventional method of blowing CO gas into molten copper through a graphite nozzle.

TABLE 1

| SPECIMEN | | CHEMICAL COMPOSITION Cr (wt %) | Zr (wt %) | Si (wt %) | Mg (wt %) | O (ppm) | Cu AND INEVITABLE IMPURITIES |
|---|---|---|---|---|---|---|---|
| BILLETS OF PRESENT INVENTION | A | 0.73 | 0.15 | 0.03 | 0.02 | 3 | BALANCE |
| | B | 0.30 | 0.15 | 0.02 | 0.03 | 3 | BALANCE |
| | C | 0.18 | 0.23 | 0.09 | 0.02 | 5 | BALANCE |
| | D | 0.45 | 0.19 | 0.02 | 0.002 | 5 | BALANCE |
| | E | 0.21 | 0.10 | 0.04 | — | 6 | BALANCE |
| | F | 0.31 | 0.08 | 0.02 | — | 4 | BALANCE |
| | G | 0.17 | 0.10 | 0.08 | — | 4 | BALANCE |
| | H | 0.68 | 0.03 | 0.04 | — | 6 | BALANCE |
| | I | 0.50 | 0.08 | — | — | 2 | BALANCE |
| | J | 0.18 | 0.25 | — | — | 7 | BALANCE |
| | K | 0.32 | 0.14 | — | — | 5 | BALANCE |

TABLE 2

| SPECIMEN | | CHEMICAL COMPOSITION Cr (wt %) | Zr (wt %) | Si (wt %) | Mg (wt %) | O (ppm) | CU AND INEVITABLE IMPURITIES |
|---|---|---|---|---|---|---|---|
| COMPARATIVE BILLETS | a | 0.95* | 0.10 | 0.02 | — | 15* | BALANCE |
| | b | 0.18 | 0.35* | 0.02 | 0.03 | 13* | BALANCE |
| | c | 0.57 | 0.07 | 0.15* | 0.03 | 5 | BALANCE |
| | d | 0.30 | 0.18 | 0.005* | 0.01 | 4 | BALANCE |
| | e | 0.25 | 0.08 | 0.03 | 0.10* | 3 | BALANCE |
| | f | 0.55 | 0.07 | 0.02 | 0.03 | 12* | BALANCE |
| | g | 0.36 | 0.12 | 0.04 | — | 23* | BALANCE |
| CONVENTIONAL BILLET | | 0.23 | 0.20 | 0.0006 | 0.10 | 18* | BALANCE |

NOTE: Symbol * indicates a value outside the range according to the present invention

EXAMPLE 1

Billet specimens (A) to (K) of the present invention, comparative billet specimens (a) to (g), and a conventional billet specimen each having a chemical composition shown in Table 1 or 2 were heated to temperatures shown in Table 3, and then roughly hot rolled at drafts shown in Table 3, followed by allowing them to cool in air. Further, the specimens were heated to temperatures shown in Table 3 at which solution treatment was to be conducted, respectively, followed by water cooling to effect solution treatment, thereby producing element wires. Oxides on surfaces of the thus produced element wires were removed, and then first cold drawing was effected so that the surface area of the wire was reduced by 50%. Thereafter, the resulting wires were charged into a bright annealing furnace to conduct aging treatment at 460° C. for 2 hours, and then second cold drawing was effected so that the surface area of the wire was reduced by 85%. Further, the resulting wires were again charged into the bright annealing furnace to conduct aging treatment at 440° C. for two hours, thereby preparing wire specimens according to the present invention Nos. 1 to 11, comparative wire specimens Nos. 1 to 7, and a conventional wire specimen.

These wire specimens were measured in respect of tensile strength at a portion other than a pressure welded portion thereof and that at the pressure welded portion by a method according to JIS E 2101. With respect to the strength at the pressure welded portion, specimens having the pressure welded portion with tensile strength 95% or more of the tensile strength at the other portion was classified as A, those having the pressure welded portion with tensile strength not smaller than 85% but smaller than 95% of the tensile strength at the other portion as B, and those having the pressure welded portion with tensile strength less than 85% of the tensile strength at the other portion as C, respectively. The measurement results are shown in Table 3. Further, the electric conductivity of each of the wires was measured over a length of 1 m by a double bridge method according to JIS C 3001, and still further, the wear resistance current-collecting sliding was measured by means of a device shown in the single FIGURE.

In the FIGURE, reference numeral 1 designates a rotor, 2 a wire to be tested, 3 a current-collecting plate (slider), and 4 a volt meter, respectively.

As the wire 2 in the FIGURE, each of the wire specimens Nos. 1 to 11 of the present invention, the comparative wire specimens Nos. 1 to 7, and the conventional wire was wound around the rotor 1 having a diameter of 50 cm. On the other hand, the current collecting plate 3 comprised of an iron slider for pantograph (Model M-39 ®, manufactured by Mitsubishi Materials Corporation, Japan, for example) was pressured against the wire at a pressuring force of 2 kgf, and the rotor 1 was rotated at a peripheral speed of 15 kph for 60 minutes while applying a direct current of 20 A and 100 V to the plate 3. Thus, the current-collecting sliding wear properties of the wires, e.g. the wear rate of the current collecting plate, the wear rate of the wire cross sectional area, the arcing rate, etc., were measured. The measurement results are shown in Table 3. The wear rate of the current-collecting plate was obtained by converting the rotating speed of the rotor into a distance value, and then dividing the decrease in the weight of the current-collecting plate by the distance value. The wear rate of the wire cross sectional area was obtained by accurately measuring the diameter of the wire after the test by means of a micrometer, and then dividing the decrease in the diameter by the value of the rotating speed. Further, a potential difference of 10 to 20 V is generated at the time of arcing. Therefore, when a potential difference of 6 V to 50 V inclusive was generated, it was regarded that arcing occurred, and when a test was conducted on the current-collecting sliding wear, the potential difference was measured at every two minutes for ten seconds by means of a volt meter. The thus measured values were continuously recorded in a chart to obtain an arcing time period, and the percentage of the arcing time period in the above 10 seconds was determined as an arcing rate.

Further, with respect to the wire specimens Nos. of the present invention Nos. 1 to 11, the comparative wire specimen Nos. 1 to 7, and the conventional wire specimen, a high-temperature creep rupture test was conducted by applying a load of 15 kgf/mm$^2$ and a load of 30 kgf/mm$^2$ to the specimen each at 200° C. for 2000 hours to measure a time period from the start of the test until occurrence of a rupture. The results are shown in Table 3.

Still further, each of the wire specimens Nos. of the present invention 1 to 11, the comparative wire specimens Nos. 1 to 7, and the conventional wire specimen was bent by 90 degrees from a vertical position to a horizontal position and then returned to the original or vertical position (first bending). Next, each of the wire specimens was bent by 90 degrees from the original vertical direction to a horizontal direction opposite to that of the first bending and then returned to the original vertical position (second bending). The first and second bendings were counted as two. The above bending operations were repeated until a rupture occurred, and the number of times of bending operations was counted. The results are shown in Table 3.

Still further, each of the wire specimens Nos. 1 to 11 of the present invention, the comparative wire specimens Nos. 1 to 7, and the conventional wire specimen each having a length of 1 m was twisted by 180 degrees in the circumferential direction (first twisting), and each of the twisted specimens was returned to the original position (second twisting). The first and second twistings were counted as two. The above twisting operations were repeated until a rupture occurred, and the number of times of twisting operations was counted. The results are also shown in Table 3.

As is apparent from Tables 1 to 3, the wire specimens Nos. 1 to 11 of the present invention are more excellent than the conventional wire specimen in all of pressure welding strength, current-collecting sliding wear properties, high-temperature creep strength, and other mechanical strength. However, it is learned from the tables that the comparative wire specimens Nos. 1 to 7, which each have at least one of the component elements having a content falling outside the range of the present invention, are inferior in one of the above-mentioned properties to the wires of the present invention.

TABLE 3

| SPECIMEN | BILLET | HOT WORKING CONDITIONS HEATING TEMPERATURE (°C.) | HOT WORKING CONDITIONS DRAFT (%) | SOLUTION TREATMENT TEMPERATURE (°C.) | TENSILE STRENGTH AT PORTION OTHER THAN PRESSURE WELD (kg/mm$^2$) | ELECTRIC CONDUCTIVITY (% IACS) | BENDING TIME NUMBER | TWISTING TIME NUMBER |
|---|---|---|---|---|---|---|---|---|
| WIRES OF PRESENT INVENTION | | | | | | | | |
| 1 | A | 900 | 99 | 950 | 63.3 | 80.1 | 17 | 520 |
| 2 | B | 900 | 99 | 950 | 61.8 | 78.4 | 18 | 530 |
| 3 | C | 900 | 99 | 920 | 61.3 | 78.2 | 17 | 510 |
| 4 | D | 900 | 99 | 920 | 61.7 | 79.6 | 17 | 515 |
| 5 | E | 930 | 99 | 900 | 60.4 | 80.1 | 19 | 530 |
| 6 | F | 930 | 99 | 900 | 62.9 | 79.9 | 18 | 520 |
| 7 | G | 930 | 99 | 880 | 60.5 | 80.3 | 20 | 540 |
| 8 | H | 930 | 99 | 880 | 62.3 | 78.6 | 18 | 520 |
| 9 | I | 900 | 99 | 950 | 61.5 | 80.2 | 21 | 550 |
| 10 | J | 930 | 99 | 950 | 62.4 | 79.6 | 21 | 540 |

TABLE 3-continued

| | | | | | | | | |
|---|---|---|---|---|---|---|---|---|
| 11 | K | 950 | 99 | 950 | 62.8 | 80.4 | 20 | 545 |
| COMPARATIVE WIRES | | | | | | | | |
| 1 | a | 900 | 99 | 950 | 60.2 | 79.2 | 6 | 415 |
| 2 | b | 900 | 99 | 950 | 62.2 | 76.3 | 8 | 420 |
| 3 | c | 930 | 99 | 900 | 59.5 | 69.3 | 13 | 370 |
| 4 | d | 930 | 99 | 900 | 59.5 | 80.4 | 12 | 390 |
| 5 | e | 900 | 99 | 950 | 61.7 | 74.5 | 13 | 410 |
| 6 | f | 900 | 99 | 950 | 57.3 | 80.2 | 7 | 420 |
| 7 | g | 900 | 99 | 950 | 61.3 | 79.4 | 5 | 365 |
| CONVENTIONAL WIRE | CONVENTIONAL BILLET | 750 | 99 | 800 | 45.3 | 88.7 | 7 | 380 |

| | | HIGH TEMP. CREEP RUPTURE TEST AT 200° C. TIME PERIOD: 2000 HR | | CURRENT-COLLECTING SLIDING WEAR PROPERTIES | | |
|---|---|---|---|---|---|---|
| SPECIMEN | PRESSURE WELDING STRENGTH | LOAD 15 kgf/mm$^2$ | LOAD 30 kgf/mm$^2$ | WEAR RATE OF CURRRENT COLLECTING PLATE (mg/10 km) | WEAR RATE OF WIRE CROSS SECTIONAL AREA $\times 10^{-4}$ mm$^2$ /test | ARCING RATE (%) |
| WIRES OF PRESENT INVENTION | | | | | | |
| 1 | A | NO RUPTURE | NO RUPTURE | 131.3 | 4 | 4.83 |
| 2 | A | NO RUPTURE | NO RUPTURE | 113.4 | 6 | 5.73 |
| 3 | A | NO RUPTURE | NO RUPTURE | 138.8 | 7 | 6.11 |
| 4 | A | NO RUPTURE | NO RUPTURE | 118.2 | 5 | 4.29 |
| 5 | A | NO RUPTURE | NO RUPTURE | 133.8 | 6 | 4.87 |
| 6 | A | NO RUPTURE | NO RUPTURE | 119.8 | 7 | 5.88 |
| 7 | A | NO RUPTURE | NO RUPTURE | 132.5 | 6 | 3.22 |
| 8 | A | NO RUPTURE | NO RUPTURE | 120.0 | 5 | 6.36 |
| 9 | A | NO RUPTURE | NO RUPTURE | 109.2 | 4 | 5.21 |
| 10 | A | NO RUPTURE | NO RUPTURE | 117.8 | 5 | 4.39 |
| 11 | A | NO RUPTURE | NO RUPTURE | 122.4 | 4 | 4.88 |
| COMPARATIVE WIRES | | | | | | |
| 1 | C | 1330 | 940 | 187.7 | 8 | 8.22 |
| 2 | C | 1420 | 1080 | 193.5 | 5 | 8.53 |
| 3 | A | NO RUPTURE | 1220 | 119.7 | 6 | 6.22 |
| 4 | B | NO RUPTURE | 1460 | 153.8 | 11 | 7.94 |
| 5 | B | NO RUPTURE | 1540 | 182.3 | 12 | 4.33 |
| 6 | B | 1280 | 880 | 177.3 | 14 | 10.31 |
| 7 | C | 1020 | 520 | 196.5 | 15 | 11.82 |
| CONVENTIONAL WIRE | C | 1470 | 980 | 167.2 | 10 | 10.44 |

EXAMPLE 2

The billet specimen (C) of the present invention having a composition shown in Table 1 was heated to 930° C. under an atmosphere of CO gas, and the thus heated billet C was roughly hot rolled at a draft of 92% (while maintaining the temperature at 860° C. or above), followed by immediately water cooling, to thereby prepare an element wire. The thus prepared element wire was subjected to removal of surface oxides thereof, and then first cold drawing was effected so that the surface area was reduced by 50%. Thereafter, the resulting wire was charged into a bright annealing furnace to conduct an initial aging treatment under conditions as shown in Table 4, and then second cold drawing was effected so that the surface area was reduced by 85%. Further, the resulting wire was again charged into the bright annealing furnace to conduct secondary aging treatment under conditions as shown in Table 4, thereby obtaining wire specimens according to methods Nos. 1 to 6 of the present invention, and comparative wire specimens according to comparative methods Nos. 1 to 4. The wire specimens obtained according to the methods of the present invention and the comparative methods were measured in respect of tensile strength, elongation, and electric conductivity. The measurement results are shown in Table 4.

TABLE 4

| | | INITIAL AGING TREATMENT | | SECONDARY AGING TREATMENT | | | | |
|---|---|---|---|---|---|---|---|---|
| METHOD | | TEMPERATURE (°C.) | HEATING TIME PERIOD (hr.) | TEMPERATURE (°C.) | HEATING TIME PERIOD (hr.) | TENSILE STRENGTH (kgf/mm$^2$) | ELONGATION (%) | ELECTRIC CONDUCTIVITY % IACS |
| METHODS | 1 | 460 | 2 | 460 | 2 | 58.5 | 18.2 | 82.4 |
| OF | 2 | 460 | 2 | 440 | 2 | 61.2 | 15.5 | 80.2 |
| PRESENT | 3 | 550 | 0.5 | 510 | 0.5 | 57.8 | 19.4 | 82.6 |
| INVENTION | 4 | 550 | 0.5 | 480 | 1 | 60.3 | 18.5 | 81.5 |

TABLE 4-continued

| METHOD | | INITIAL AGING TREATMENT TEMPERATURE (°C.) | INITIAL AGING TREATMENT HEATING TIME PERIOD (hr.) | SECONDARY AGING TREATMENT TEMPERATURE (°C.) | SECONDARY AGING TREATMENT HEATING TIME PERIOD (hr.) | TENSILE STRENGTH (kgf/mm²) | ELONGATION (%) | ELECTRIC CONDUCTIVITY % IACS |
|---|---|---|---|---|---|---|---|---|
| | 5 | 380 | 6 | 360 | 6 | 57.5 | 12.7 | 77.5 |
| | 6 | 400 | 3 | 375 | 5 | 59.1 | 14.4 | 79.5 |
| COMPARATIVE METHODS | 1 | *610 | 0.5 | 450 | 2 | 53.3 | 7.5 | 65.5 |
| | 2 | *330 | 6 | 310 | 6 | 49.5 | 4.5 | 58.2 |
| | 3 | 370 | 4 | *620 | 0.5 | 48.5 | 20.2 | 62.4 |
| | 4 | 460 | 2 | *340 | 6 | 56.5 | 5.6 | 60.1 |

NOTE: Symbol * indicates a value outside the range of the invention

As is apparent from Table 4, the wire specimens according to the methods Nos. 1 to 4 of the present invention are conspicuously excellent in tensile strength and elongation as compared with the comparative wire specimens according to the comparative methods Nos. 1 to 4, which were each obtained by aging treatment at a temperature falling outside the range of the present invention. Further, by comparing the wires obtained by methods Nos. 1 and 2 according to the present invention with the specimens according to the comparative methods Nos. 3 and 4, it is found that when the temperature of the secondary aging treatment is made lower than the temperature of the initial aging treatment, the tensile strength of the wire is much improved.

EXAMPLE 3

The billet specimens (A) to (F) of the present invention each having a composition shown in Table 1 were heated to temperatures shown in Table 5 under an atmosphere of CO gas, and the thus heated billets (A) to (F) were roughly hot rolled at drafts shown in Table 5, followed by immediately water cooling, to thereby produce element wires. Each of the thus produced element wires was subjected to removal of surface oxides thereof, and then, first to twelfth cold drawing operations were continuously conducted, thereby effecting cold drawing at the total surface area reduction ratio of 92.5%. Thereafter, the cold rolled wires were charged into a bright annealing furnace to conduct aging treatment at 460° C. for 2 hours, thus producing wire specimens according to methods Nos. 7 to 12 according to the present invention under conditions shown in Table 5.

TABLE 5

| TYPE | | BILLET | HOT WORKING CONDITIONS HEATING TEMPERATURE (°C.) | HOT WORKING CONDITIONS DRAFT (%) | TEMPERATURE OF ELECTRIC WIRE AT WATER COOLING (°C.) | TENSILE STRENGTH (kgf/mm²) | ELONGATION (%) | ELECTRIC CONDUCTIVITY % IACS |
|---|---|---|---|---|---|---|---|---|
| METHODS OF PRESENT INVENTION | 7 | A | 870 | 97 | 870 | 58.4 | 15.3 | 78.2 |
| | 8 | B | 930 | 97 | 910 | 59.5 | 13.5 | 78.3 |
| | 9 | C | 950 | 92 | 920 | 60.5 | 14.8 | 78.5 |
| | 10 | D | 980 | 96 | 950 | 60.2 | 15.4 | 79.2 |
| | 11 | E | 900 | 94 | 870 | 58.9 | 14.6 | 78.0 |
| | 12 | F | 890 | 97 | 860 | 57.5 | 14.8 | 78.2 |

As is apparent from Table 5, the wire after hot working can be immediately water cooled without cooling the same in air. Further, by continuously repeating cold working operations many times and subsequently performing final aging treatment once, wires having excellent properties can be produced, as well.

What is claimed is:

1. A method of producing a wire for an electric railway, comprising the steps of:
   (a) hot working a copper alloy billet consisting essentially, by weight percent, of 0.1 to 1.0% Cr, 0.01 to 0.3% Zr, 10 ppm or less O, and the balance being Cu and inevitable impurities, at a temperature of 860° to 1000° C. and at a draft of 90% or more into an element wire;
   (b) then immediately quenching the element wire from step (a);
   (c) cold working the quenched element wire from step (b) at least once; and
   (d) aging the cold worked element wire from step (c).

2. The method as claimed in claim 1, wherein said copper alloy billet further contains 0.01 to 0.1% Si.

3. The method as claimed in claim 2, wherein said hot working comprises hot rolling.

4. The method as claimed in claim 2, wherein said cold working comprises cold drawing at a surface area reduction ratio of 40% or more.

5. The method as claimed in claim 2, wherein said aging is carried out at a temperature of 350° to 600° C. for 0.1 to 6 hours.

6. The method as claimed in claim 2, wherein said copper alloy billet is prepared by the steps of:
   (i) melting copper while blowing a reducing gas into the copper in a melt state;
   (ii) temporarily adding copper oxide to the resulting molten copper during said step (i) to prepare a molten copper having an oxygen content of 10 ppm or less;
   (iii) adding Cr, Zr and Si to the molten copper from step (ii) in amounts, by weight percent, of 0.1 to 10% Cr, 0.01 to 0.3Zr, and 0.01 to 0.1% Si; and
   (iv) casting the molten copper containing the Cr, Zr and Si from step (iii) in a metal mold.

7. The method as claimed in claim 1, wherein said copper alloy billet further contains 0.01 to 0.1% Si, and 0.001 to 0.3% Mg.

8. The method as claimed in claim 7, wherein said hot working comprises hot rolling.

9. The method as claimed in claim 7, wherein said cold working comprises cold drawing at a surface area reduction ratio of 40% or more.

10. The method as claimed in claim 7, wherein said aging is carried out at a temperature of 350° to 600° C. for 0.1 to 6 hours.

11. The method as claimed in claim 7, wherein said copper alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding Cr, Zr, Si and Mg to the molten copper from step (ii) in amounts, by weight percent, of 0.1 to 10% Cr, 0.01 to 0.3% Zr 0.01 to 0.1% Si, and 0.001 to 0.05% Mg; and (iv) casting the molten copper containing the Cr, Zr, Si and Mg from step (iii) in a metal mold.

12. The method as claimed in claim 1, wherein said hot working is hot rolling.

13. The method as claimed in claim 1, wherein said cold working comprises cold drawing at a surface area reduction of 40% or more.

14. The method as claimed in claim 1, wherein said aging is carried out at a temperature of 350° to 600° C. for 0.1 to 6 hours.

15. The method as claimed in claim 1, wherein said copper alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding said Cr and Zr to the molten copper from step (ii) in amounts, by weight percent, of 0.1 to 10% Cr, and 0.01 to 0.3% Zr; and (iv) casting the molten copper containing the Cr and Zr from step (iii) in a metal mold.

16. The method as claimed in claim 1, wherein the Cr is in an amount of 0.15 to 0.50 weight %, the Zr is in an amount of 0.05 to 0.25 weight % and the O is in amount of 1 to 7 ppm.

17. The method as claimed in claim 16, wherein said copper alloy billet further contains 0.01 to 0.05 weight % Si.

18. The method as claimed in claim 16, wherein said copper alloy billet further contains 0.01 to 0.05 weight % Si and 0.005 to 0.03 weight % Mg.

19. A method of producing a wire for an electric railway, comprising the steps of:

(a) hot working a copper alloy billet consisting essentially, by weight percent, of 0.1 to 1.0% Cr, 0.01 to 0.3% Zr, 10 ppm or less O, and the balance being Cu and inevitable impurities, at a temperature of 860° to 1000° C. and at a draft of 90% or more into an element wire;

(b) then immediately quenching the element wire from step (a); and (c) subjecting the element wire from step (b) to at least two repeated cycles of cold working and aging.

20. The method as claimed in claim 19, wherein said copper alloy billet further contains 0.01 to 0.1% Si.

21. The method as claimed in claim 20, wherein said hot working comprises hot rolling.

22. The method as claimed in claim 20, wherein said cold working of each of said at least two repeated cycles comprises cold drawing at a surface area reduction ratio of 40% or more.

23. The method as claimed in claim 20, wherein said aging of each of said at least two repeated cycles is carried out at a temperature of 350° to 600° C. for 0.1 to 6 hours.

24. The method as claimed in claim 20, wherein said copper alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding Cr, Zr and Si to the molten copper from step (i) in amounts, by weight percent, of 0.1 to 1.0% Cr, and 0.01 to 0.3% Zr, and 0.01 to 0.1% Si; and (iv) casting the molten copper containing the Cr, Zr and Si from step (iii) in a metal mold.

25. The method as claimed in claim 19, wherein said copper alloy billet further contains 0.01 to 0.1% Si, and 0.001 to 0.3% Mg.

26. The method as claimed in claim 23, wherein said hot working comprises hot rolling.

27. The method as claimed in claim 25, wherein said cold working of each of said at least two repeated cycles comprises cold drawing at a surface area reduction ratio of 40% or more.

28. The method as claimed in claim 25, wherein said aging of each of said at least two repeated cycles is carried out at a temperature of 350° to 600° C. for 0.1 to 6 hours.

29. The method as claimed in claim 25, wherein said copper, alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding Cr, Zr, Si and Mg to the molten copper from step (ii) in amounts, by weight percent, of 0.1 to 1.0% Cr, 0.01 to 0.3% Zr, 0.01 to 0.1% Si, and 0.001 to 0.05% Mg; and (iv) casting the molten copper containing the Cr, Zr, Si and Mg from step (iii) in a metal mold.

30. The method as claimed in claim 19, wherein said at least two repeated cycles of cold working and aging includes at least two operations of aging, the last aging operation being carried out at a temperature lower than a temperature at which at least one preceding aging operation is carried out.

31. The method as claimed in claim 19, wherein said hot working comprises hot rolling.

32. The method as claimed in claim 19, wherein said cold working of each of said at least two repeated cycles comprises cold drawing at a surface area reduction ratio of 40% or more.

33. The method as claimed in claim 19, wherein said aging of each of said at least two repeated cycles is carried out at a temperature of 350° to 600° C. for 0.1 to 6 hours.

34. The method as claimed in claim 19, wherein said copper alloy billet is prepared by the steps of:

(i) melting copper while blowing a reducing gas into the copper in a melt state;
(ii) temporarily adding copper oxide to the resulting molten copper during said step (i) to prepare a molten copper having an oxygen content of 10 ppm or less;
(iii) adding said Cr and Zr to the molten copper from step (ii) in amounts by weight percent, of 0.1 to 1.0% Cr, and 0.01 to 0.3% Zr; and
(iv) casting the molten copper containing the Cr and Zr from step (iii) in a metal mold.

35. The method as claimed in claim 19, wherein the Cr is in an amount of 0.15 to 0.50 weight %, the Zr is in an amount of 0.05 to 0.25 weight % and the O is in amount of 1 to 7 ppm.

36. The method as claimed in claim 35, wherein said copper alloy billet further contains 0.01 to 0.05 weight % Si.

37. The method as claimed in claim 35, wherein said copper alloy billet further contains 0.01 to 0.05 weight % Si and 0.005 to 0.03 weight % Mg.

38. A method of producing a wire for an electric railway, comprising the steps of:
(a) hot working a copper alloy billet consisting essentially, by weight percent, of 0.1 to 1.0% Cr, 0.01 to 0.3% Zr, 10 ppm or less O, and the balance being Cu and inevitable impurities, at a temperature of 860° to 1000° C. and at a draft of 90% or more into an element wire;
(b) then allowing the element wire from step (a) to cool in air;
(c) subjecting the cooled element wire from step (b) to a solution treatment, including heating the cooled element wire to a temperature of 860° to 1000° C. and then quenching the element wire;
(d) cold working the quenched element wire from step (c) at least once; and
(e) aging the cold worked element wire from step (d).

39. The method as claimed in claim 38, wherein said copper alloy billet further contains 0.01 to 0.1% Si.

40. The method as claimed in claim 39, wherein said hot working comprises hot rolling.

41. The method as claimed in claim 39, wherein said cold working comprises cold drawing at a surface area reduction ratio of 40% or more.

42. The method as claimed in claim 39, wherein said aging is carried out at a temperature of 350° to 600° C. for 0.1 to 6 hours.

43. The method as claimed in claim 39, wherein said copper alloy billet is prepared by the steps of:
(i) melting copper while blowing a reducing gas into the copper in a melt state;
(ii) temporarily adding copper oxide to the resulting molten copper during said step (i) to prepare a molten copper having an oxygen content of 10 ppm or less;
(iii) adding Cr, Zr and Si to the molten copper from step (ii) in amounts, by weight percent, of 0.1 to 1.0% Cr, 0.01 to 0.3% Zr, and 0.01 to 0.1% S i; and
(iv) casting the molten copper containing the Cr, Zr and Si from step (iii) in a metal mold.

44. The method as claimed in claim 38, wherein said copper alloy billet further contains 0.01 to 0.1% Si, and 0.001 to 0.3% Mg.

45. The method as claimed in claim 44, wherein said hot working comprises hot rolling.

46. The method as claimed in claim 44, wherein said cold working comprises cold drawing at a surface area reduction ratio of 40% or more.

47. The method as claimed in claim 44, wherein said aging is carried out at a temperature of 350° to 600° C. for 0.1 to 6 hours.

48. The method as claimed in claim 44, wherein said copper alloy billet is prepared by the steps of:
(i) melting copper while blowing a reducing gas into the copper in a melt state;
(ii) temporarily adding copper oxide to the resulting molten copper during said step (i) to prepare a molten copper having an oxygen content of 10 ppm or less;
(iii) adding Cr, Zr, Si and Mg to the molten copper from step (ii) in amounts, by weight percent, of 0.1 to 10% Cr, 0.01 to 0.3% Zr, 0.01 to 0.1% Si, and 0.001 to 0.05% Mg; and
(iv) casting the molten copper containing the Cr, Zr, Si and Mg from step (iii) in a metal mold.

49. The method as claimed in claim 38, wherein said hot working comprises hot rolling.

50. The method as claimed in claim 38, wherein said cold working comprises cold drawing at a surface area reduction ratio of 40% or more.

51. The method as claimed in claim 38, wherein said aging is carried out at a temperature of 350° to 600° C. for 0.1 to 6 hours.

52. The method as claimed in claim 38, wherein said copper alloy billet is prepared by the steps of:
(i) melting copper while blowing a reducing gas into the copper in a melt state;
(ii) temporarily adding copper oxide to the resulting molten copper during said step (i) to prepare a molten copper having an oxygen content of 10 ppm or less;
(iii) adding Cr and Zr to the molten copper from step (ii) in amounts, by weight percent, of 0.1 to 1.0% Cr, and 0.01 to 0.3% Zr; and
(iv) casting the molten copper containing the Cr and Zr from step (iii) in a metal mold.

53. The method as claimed in claim 38 wherein the Cr is in an amount of 0.15 to 0.50 weight %, the Zr is in an amount of 0.05 to 0.25 weight % and the O is in an amount of 1 to 7 ppm.

54. The method as claimed in claim 53, wherein said copper alloy billet further contains 0.01 to 0.05 weight % Si.

55. The method as claimed in claim 53, wherein said copper alloy billet further contains 0.01 to 0.05 weight % Si and 0.005 to 0.03 weight % Mg.

56. A method of producing a wire for an electric railway, comprising the steps of:
(a) hot working a copper alloy billet consisting essentially, by weight percent, of 0.1 to 1.0% Cr, 0.01 to 0.3% Zr, 10 ppm or less O, and the balance being Cu and inevitable impurities, at a temperature of 860° to 1000° C. and at a draft of 90% or more into an element wire;
(b) then allowing the element wire from step (a) to cool in air;
(c) subjecting the cooled element wire from step (b) to a solution treatment, including heating the cooled element wire to a temperature of 860° to 1000° C. and then quenching the element wire; and
(d) subjecting the element wire from step (c) to at least two repeated cycles of cold working and aging.

57. The method as claimed in claim 56, wherein said copper alloy billet further contains 0.01 to 0.1% Si.

58. The method as claimed in claim 57, wherein said hot working comprises hot rolling.

59. The method as claimed in claim 57, wherein said cold working of each of said at least two repeated cycles comprises cold drawing at a surface area reduction ratio of 40% or more.

60. The method as claimed in claim 57, wherein said aging of each of said at least two repeated cycles is carried out at a temperature of 350° to 600° C. for 0.1 to 6 hours.

61. The method as claimed in claim 57, wherein said copper alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding Cr, Zr and Si to the molten copper from step (ii) in amounts, by weight percent, of 0.1 to 10% Cr, 0.01 to 0.3% Zr, and 0.01 to 0.1% Si; and (iv) casting the molten copper containing the Cr, Zr and Si from step (iii) in a metal mold.

62. The method as claimed in claim 56, wherein said copper alloy billet further contains 0.01 to 0.1% Si, and 0.001 to 0.3% Mg.

63. The method as claimed in claim 62, wherein said hot working comprises hot rolling.

64. The method as claimed in claim 62, wherein said cold working of each of said at least two repeated cycles comprises cold drawing at a surface area reduction ratio of 40% or more.

65. The method as claimed in claim 62, wherein said aging of each of said at least two repeated cycles is carried out at a temperature of 350° to 600° C. for 0.1 to 6 hours.

66. The method as claimed in claim 62, wherein said copper alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding Cr, Zr, Si and Mg to the molten copper in amounts, by weight percent, of 0.1 to 1.0% Cr, 0.01 to 0.3%.Zr, 0.01 to 0.1% Si, and 0.001 to 0.05% Mg; and (iv) casting the molten copper containing the Cr, Zr, Si and Mg from step (iii) in a metal mold.

67. The method as claimed in claim 56, wherein said hot working comprises hot rolling.

68. The method as claimed in claim 56, wherein said cold working of each of said at least two repeated cycles comprises cold drawing at a surface area reduction ratio of 40% or more.

69. The method as claimed in claim 56, wherein said aging of each of said at least two repeated cycles is carried out at a temperature of 350° to 600° C. for 0.1 to 6 hours.

70. The method as claimed in claim 56, wherein said at least two repeated cycles of cold working and aging includes at least two operations of aging the last aging operation being carried out at a temperature lower than a temperature at which at least one preceding aging operation is carried out.

71. The method as claimed in claim 56, wherein said copper alloy billet is prepared by the steps of:

(i) melting copper while blowing a reducing gas into the copper in a melt state;

(ii) temporarily adding copper oxide to the resulting molten copper during said step (i) to prepare a molten copper having an oxygen content of 10 ppm or less;

(iii) adding Cr and Zr to the molten copper from step (ii) in amounts, by weight percent, of 0.1 to 1.0% Cr, and 0.01 to 0.3% Zr; and (iv) casting the molten copper containing the Cr and Zr from step (iii) in a metal mold.

72. The method as claimed in claim 56, wherein the Cr is in an amount of 0.15 to 0.50 weight %, the Zr is in an amount of 0.05 to 0.25 weight % and the O is in an amount of 1 to 7 ppm.

73. The method as claimed in claim 72, wherein said copper alloy billet further contains 0.01 to 0.05 weight % Si.

74. The method as claimed in claim 72, wherein said copper alloy billet further contains 0.01 to 0.05 weight % Si and 0.005 to 0.03 weight % Mg.

* * * * *

UNITED STATES PATENT AND TRADEMARK OFFICE

CERTIFICATE OF CORRECTION

PATENT NO. : 5,391,243

DATED : February 21, 1995

INVENTOR(S) : Goto et al

It is certified that error appears in the above-indentified patent and that said Letters Patent is hereby corrected as shown below:

Column 16, line 27 (Claim 26): delete "claim 23" and insert --claim 25--.

Signed and Sealed this

Second Day of July, 1996

Bruce Lehman

*Attest:*

BRUCE LEHMAN

*Attesting Officer*

*Commissioner of Patents and Trademarks*